US005890837A

United States Patent [19]

Wells

[11] Patent Number: 5,890,837

[45] Date of Patent: Apr. 6, 1999

[54] MULTIPLE COMPARTMENT DRAINAGE CONDUIT WITH DIVERTERS

[76] Inventor: Raymond Wells, P.O. Box 257, Mayo, Fla. 32066

[21] Appl. No.: 941,634

[22] Filed: Oct. 2, 1997

[51] Int. Cl.[6] ..... E02B 11/00

[52] U.S. Cl. ..... 405/43; 405/36; 405/45; 405/52

[58] Field of Search ..... 405/36, 43, 45, 405/39, 52; 52/19, 20; 210/170

[56] References Cited

U.S. PATENT DOCUMENTS

| | | |
|---|---|---|
| 3,968,654 | 7/1976 | Auriemma . |
| 4,389,138 | 6/1983 | Soderstrom . |
| 4,695,188 | 9/1987 | Pulkkinen . |
| 5,480,260 | 1/1996 | Shattuck et al. . |

OTHER PUBLICATIONS

Contech Construction Products Inc., Brochure Edition 7, Dec. 1996.

*Primary Examiner*—Dennis L. Taylor
*Attorney, Agent, or Firm*—Terrance L. Siemens

[57] ABSTRACT

The invention features a multiple compartment drainage conduit with a plurality of diverter pipes connected thereto. The conduit is generally triangular in shape making leveling and burying less labor intensive, and resulting in less settling of fill material. The attached plurality of diverter pipes discharge a portion of the conduits' flow during periods of heavy rainfall or flooding, preventing a backup at the conduit inlet. The multiple compartment conduit includes a plurality of knock out plugs for the connection of diverter pipes at desired locations. Snap connections at opposite ends of the conduit are provided so that plural conduits can be interconnected.

9 Claims, 3 Drawing Sheets

MULTIPLE COMPARTMENT DRAINAGE CONDUIT WITH DIVERTERS

BACKGROUND OF THE INVENTION

1. Field of the Invention

The present invention relates to a storm water drainage system, and more particularly to a unitary multiple compartment drainage conduit to which a plurality of side diverter pipes may be connected. The invention is extremely useful in control and removal of surface storm water from a given area, in addition to carrying the excessive surface runoff that takes place during periods of excessive rainfall. Excessive surface water is diverted and discharged at predesignated locations, thus relieving any excess volume carried by the conduit and preventing the backup within the conduit and its inlet due to a lack of capacity in such emergency situations.

2. Description of the Prior Art

A common problem throughout the country and especially to residents of low lying areas, as in the Carolinas, Gulf states, Florida or other low lying areas is the problem of flooding which occurs frequently in the spring and summer months due to heavy rain storms, tropical storms and the like.

This flooding is partially the result of conventional, cylindrical drainage systems having insufficient capacity to conduct excessive storm water during these peak periods. Discharge flow rate is simply not fast enough to eliminate water or flooding at its origin. A major cause of the problem of insufficient storm water flow is simply in the circular or oval cross-section traditionally chosen for the drainage pipes. My tests have shown that an ellipsoidal cross-section will begin to cause turbulence in the flow when the water depth exceeds 60% of the pipe height. This turbulence, in turn, greatly reduces flow efficiency effectively choking off the drainage pipe at 60% of the flow rate it supposedly can handle. A choked drainage pipe translates immediately into flooded streets and major property damage. Comparison tests on my unique triangular drainage pipe show no turbulence generated at any fluid height within the pipe. This unexpected result could lead to astonishing consequences in the field of storm water drainage systems.

Drain pipes have been utilized for various applications as exemplified in the following United States Patents.

In U.S. Pat. No. 5,480,260, issued to Dennis R. Shattuck and Eric C. Volpenhein, on Jan. 2, 1996, there is disclosed a generally cylindrical ground water collection method and apparatus used to segregate ground and storm water. By contrast, the present invention is basically triangular in shape and is used for the collection and transportation of surface storm water. The multiple compartment drainage conduit is easier to install than cylindrical drainage conduits due to its triangular shape. The time-consuming process of hand filling under and around the arcuate base portion of conventional conduits is eliminated. Also, greater compaction of fill dirt covering the multiple compartment drainage conduit is possible, thereby substantially reducing ground settling after installation.

U.S. Pat. No. 4,695,188, issued to Jorma Pulkkinen, on Sep. 22, 1987, relates to a lined rock cistern having a watertight sprayed concrete lining wherein plastic pipes are embedded to carry off ground water which would accumulate and build up pressure in the concrete lining. By contrast, the instant multiple compartment conduit diverter system is basically triangular in shape and employs a multiple compartment conduit having primary and secondary compartments, with a primary compartment carrying the normal load and secondary compartments carrying any additional load and then diverting it at prespecified locations.

U.S. Pat. No. 4,389,138, issued to Gert W. Soderstrom, on Jun. 21, 1983, discloses a partitioned two chamber drainpipe which is generally cylindrical and open at its bottom. By contrast, the subject multiple compartment drainage conduit with diverters is generally triangular in cross-section with three flow chambers. A primary flow compartment, which carries approximately 75 percent of the flow volume, is interconnected with two upper chambers which carry overflow from the lower chamber and divert it to predesignated locations.

U.S. Pat. No. 3,968,654, issued to Robert S. Auriemma, on Jul. 13, 1976, discloses a coupling for underground drainage pipes. The coupling includes openings which allow drainage into a smaller set of openings in the main conduit for receiving ground water in the area. By contrast, the present invention is generally triangular in shape and provides a means for relieving overflow from the primary conduit. The instant invention further includes a self aligning and interlocking means for joining sections in a system.

A brochure of Contech Construction Products Inc., Edition 7, dated December, 1996, discloses fluted cylindrical storm drainage pipes which are made of corrugated galvanized steel and require special coupling bands to join sections together. By contrast, the instant invention does not require special coupling bands, and also is provided with diverter means which are utilized to release excess flow and eliminate a back-up at the inlet during periods of excessive rainfall.

None of the prior mentioned patents have addressed the problem of flooding or excessive surface water due to the limited flow capacity in prior drainage conduits. I have concluded that the most effective method of handling excessive discharge volume is to divert portions of the flow at specific locations.

None of the above inventions and patents, taken either singly or in combination, is seen to describe the instant invention as hereinafter described and claimed.

SUMARY OF THE INVENTION

The present invention primarily solves the problem of removal and distribution of excessive storm water. In an effort to solve this problem, I have developed a multiple compartment drainage conduit system including diverter pipes. Briefly stated, the basic unit of the system is a generally triangular, three compartment drainage conduit which may be made of fiberglass reinforced concrete, recycled plastic products, or any other suitable material. Recycled plastic is a preferred constituent material since this construction disposes of an otherwise waste substance, thereby lowering burdens imposed on landfills. A lower or base compartment is the primary flow conduit, which carries the normal flow of water. As water flow and volume increase and exceed the capacity of the primary flow conduit, water will rise and start flowing through two upper or secondary flow conduits. Moreover, as the flow and level of water increases and begins to utilize the capacity of the two upper chambers, water will be systematically diverted out of the multiple compartment conduit drainage pipe and into a plurality of diversion conduits discharging water at predesignated locations. The multiple compartment drainage conduit is capable of dispersing up to eleven inches of rainfall per hour, unlike conventional conduits that are adequate for about only three inches of rainfall per hour, thereby eliminating a backup or flooding at the inlets. Unlike circular or oval cross-section pipes this pipe will carry gravity driven flow throughout its full cross-sectional area without inducing turbulence.

The present invention due to its unique triangular shape, eliminates the need to hand fill and compact fill dirt under and around the base of the multiple compartment drainage conduit which will significantly reduce the amount of labor required for installation. Furthermore, due to the invention's unique shape, greater compaction of the fill covering the conduit is possible. With proper installation, the multiple compartment drainage conduit will significantly reduce ground settling and decrease maintenance. The generally triangular shape of the invention also adds considerable strength to the conduit, therefore increasing its life expectancy.

It should be noted that benefits from division of a liquid conduit into subdivisions are also applicable to conventional circular pipes. Suitable vertical and horizontal internal dividers or partitions may be inserted into new and existing circular and oval pipes which will then experience improved flow volumes under conditions approaching capacity of the pipes.

Accordingly, it is a principal object of the invention is to provide a multiple compartment drainage conduit with primary and secondary compartments to prevent excessive surface water build up or flooding in a given area.

Another object of the invention is to provide a drainage conduit with snap together fastening means, eliminating the need for special bands or clamps.

A further object is to include exterior knockout plugs on the drainage conduit for diverter pipe connection.

Another object of the invention is to reduce the amount of labor required to install a drainage piping system.

Another object of the invention is to provide a multiple compartment drainage conduit with self alignment and interlocking means thereby creating a smooth interior surface at conduit joints that is easily made.

Another object of the invention is to provide a drainage conduit that does not require banding at the joints between its sections.

A further object of the invention is to provide a drainage conduit system with increased life expectancy.

Yet another object of the invention is to provide a drainage conduit system which significantly reduces the settling of fill dirt.

Yet another object of the invention is to provide a drainage conduit that requires virtually no maintenance after installation.

Still another object of the invention is to provide a drainage conduit that will not choke at less than its full capacity due to induced turbulence.

A still further object of the invention is to provide improved elements and arrangements thereof in an apparatus for the purposes described which is inexpensive, dependable and fully effective in accomplishing its intended purposes.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
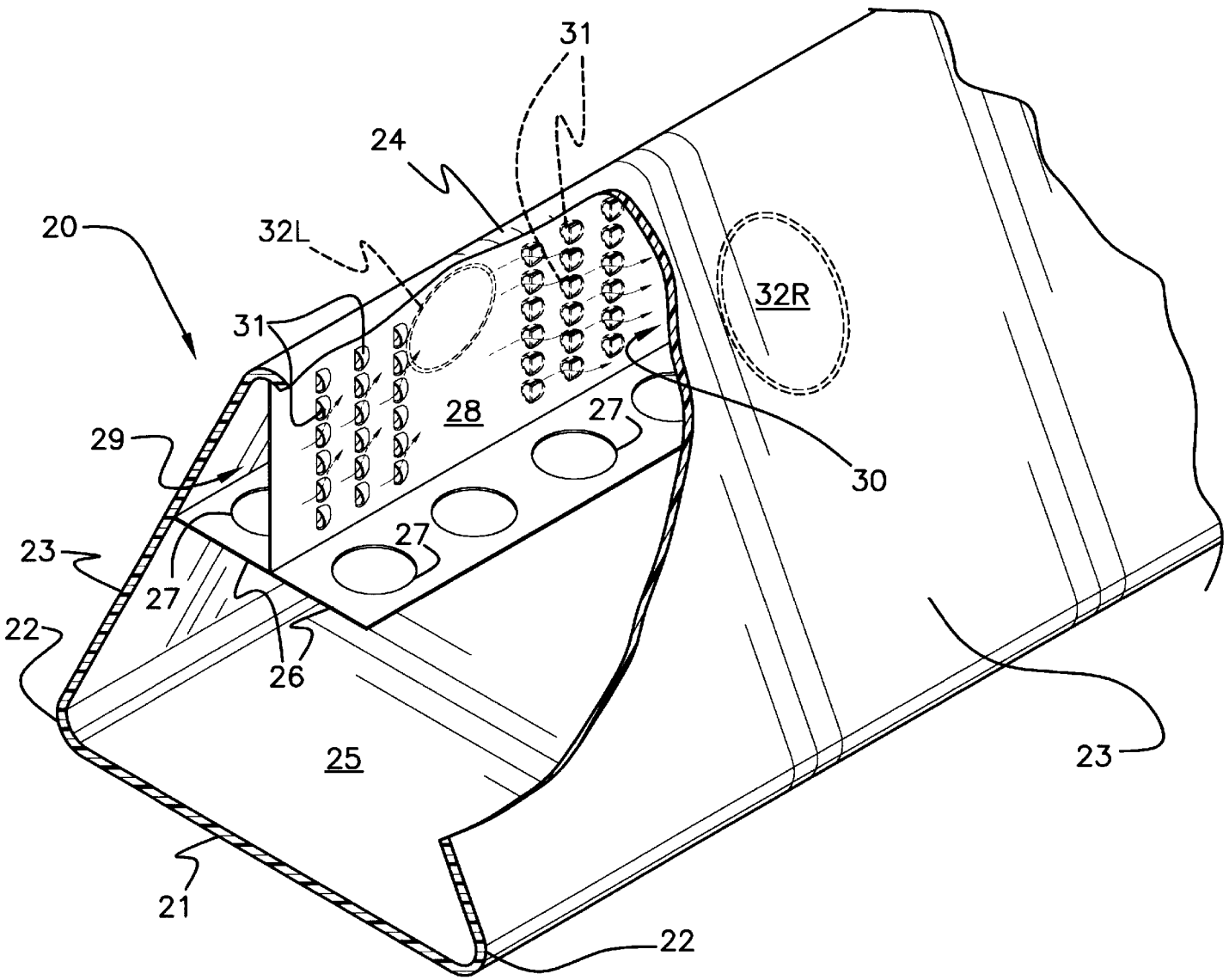
FIG. 1 is a perspective sectional view of the multiple compartment drainage conduit with one side partially cut away to reveal internal detail.

Referring now to FIG. 1 of the drawings, a perspective sectional view of the multiple compartment drainage conduit 20 is shown. Multiple compartment conduit 20 has a base portion 21 which is connected at opposite ends to a pair of upwardly and inwardly directed walls 23 which meet at an apex 24. The base 21 and diagonal walls 23 are joined at their intersections with arcuate connections 22. Both inclined walls 23 have smooth curvatures 22 at their intersections with base 21 to reduce turbulence or build up of eddies within the primary conduit 25. Approximately at the midpoint of inclined walls 23 is a horizontal partition 26 with a plurality of spaced apertures 27 therealong.

The midpoint of horizontal partition 26 is provided with a vertical partition 28 which extends from horizontal partition 26 to apex 24 forming a pair of secondary or upper compartments 29 and 30. Vertical partition 28 includes several rows of scoop openings 31, which divert flowing water into the compartment on the opposite side. For example, scoop openings 31A on vertical partition wall 28 transfer water from compartment 30 into compartment 29 near diverter outlet 32A. Downstream of scoop openings 31A are another set of rows of scoop openings 31B, with the scoops on the opposite side of vertical partition wall 28, serving to transfer water into compartment 30 to exit diverter outlet 32B. The downstream set of scoop openings 31B is shown in dotted lines since they are hidden by the right hand diagonal wall 23.

Diverter outlets 32A and 32B have had the knock-out plugs removed to better illustrate the unit. However, along the length of each section of conduit 25, there are at least two knock-outs on each side. The number of diverters will vary with system requirements. Initially diverter outlets 32A and 32B contained knock-out plugs.

As indicated above, the multiple compartment drainage conduit 20 is molded from recycled materials such as plastic or concrete. As presently configured, the lower compartment will carry approximately 75 percent of the total volume, with the upper compartment carrying approximately 25 percent. It can be seen that by elongating the angle of base 21 with respect to inclined walls 23, and by lengthening or shortening the base 21 and diagonal walls 23, different volumetric flows can be accommodated.

Figure 2:
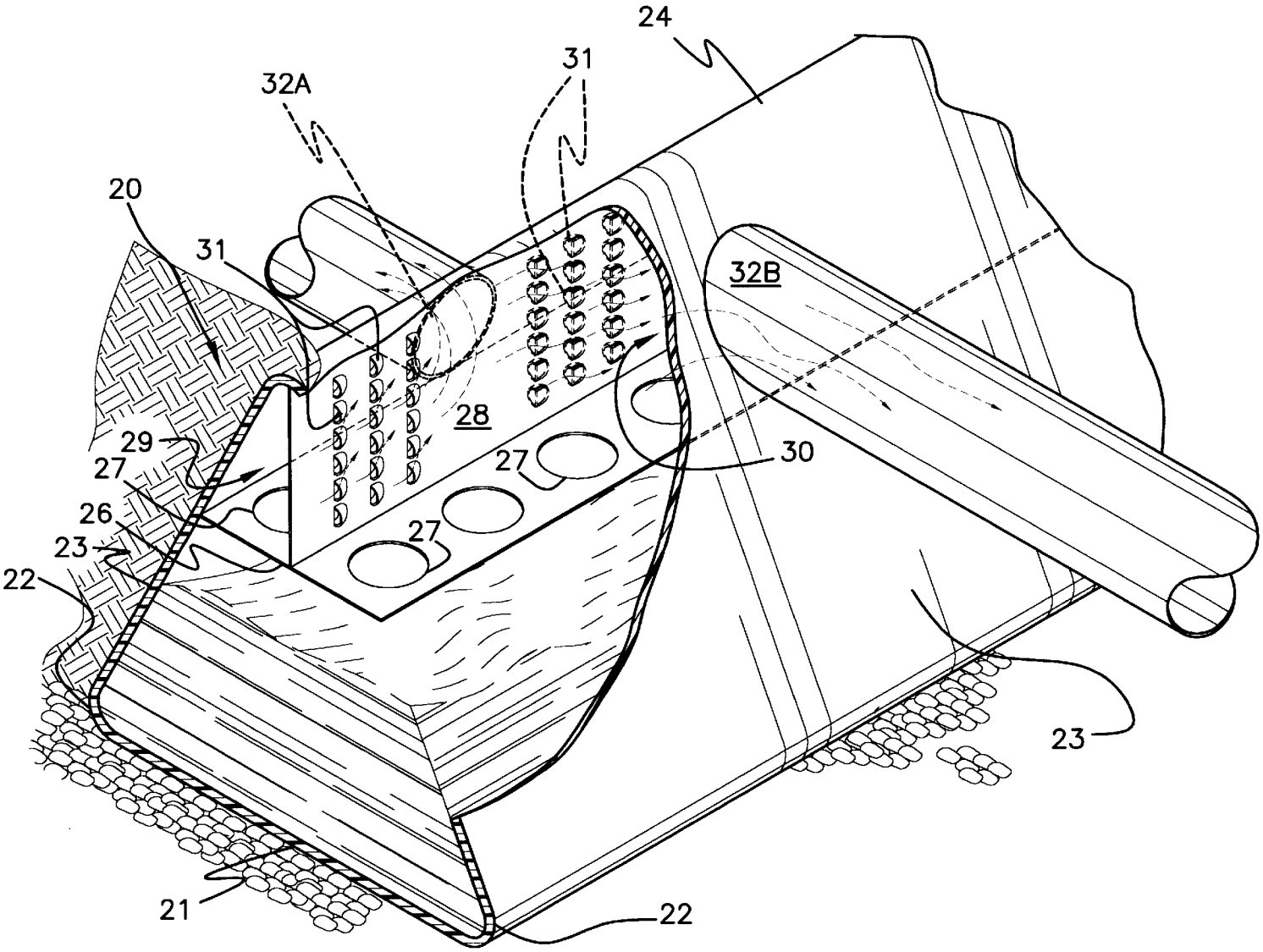
FIG. 2 is an end view disclosing the placement of the multiple compartment drainage conduit system, in a trench with a plurality of diverter conduits extending therefrom.

Referring now to FIG. 2, a cross sectional view of a trench 33 is shown, with the multiple compartment drainage conduit 20 in place therein. As indicated, a base of gravel 34 has been laid in trench 33 with gravel 34 extending upward to a height approximately equal to curvature 22 of conduit 20, thus locking the conduit 20 in place and preventing any shifting relative to the trench 33. The remainder of trench 33 is back-filled with dirt 35. Each incremental inch of fill dirt covers a larger area than the previous inch of fill dirt. Therefore, the configuration of conduit 20 allows for self-compaction to a certain degree. The normal level of water flow in conduit 20 is indicated at 40. During a period of excessive rainfall the level of water within the primary compartment 25 of conduit 20 will rise within conduit 20 and pass through apertures 27 into Diverter outlets 32A and 32B have had the knock-out plugs removed to better illustrate the unit. However, along the length of each section of conduit 25, there are at least two knock-outs on each side. The number of diverters will vary with system requirements. Initially diverter outlets 32A and 32B contained knock-out plugs.

As indicated above, the multiple compartment drainage conduit 20 is molded from recycled materials such as plastic or concrete. As presently configured, the lower compartment will carry approximately 75 percent of the total volume, with the upper compartment carrying approximately 25 percent. It can be seen that by elongating the angle of base 21 with respect to inclined walls 23, and by lengthening or shortening the base 21 and diagonal walls 23, different volumetric flows can be accommodated.

Referring now to FIG. 2, a cross sectional view of a trench 33 is shown, with the multiple compartment drainage conduit 20 in place therein. As indicated, a base of gravel 34 has been laid in trench 33 with gravel 34 extending upward to a height approximately equal to curvature 22 of conduit 20, thus locking the conduit 20 in place and preventing any shifting relative to the trench 33. The remainder of trench 33 is back-filled with dirt 35. Each incremental inch of fill dirt covers a larger area than the previous inch of fill dirt. Therefore, the configuration of conduit 20 allows for self-compaction to a certain degree. The normal level of water flow in conduit 20 is indicated at 40. During a period of excessive rainfall the level of water within the primary compartment 25 of conduit 20 will rise within conduit 20 and pass through apertures 27 into secondary compartments 29 and 30. As the level rises to level 48 in compartment 29 and 30 and simultaneously flows longitudinally therein, the water within the compartment 29 flowing along partition wall 28 is scooped up by scoop openings 31 and passes through the partition wall 28, exiting into compartment 30 at the location of diverters outlet 32B, entering diverter pipe 42 to be carried off to a remote location. Simultaneous to the flow of water through diverter outlet 32B, water is flowing out diverter outlet 32A at the opposite end of conduit 20.

Figure 3:
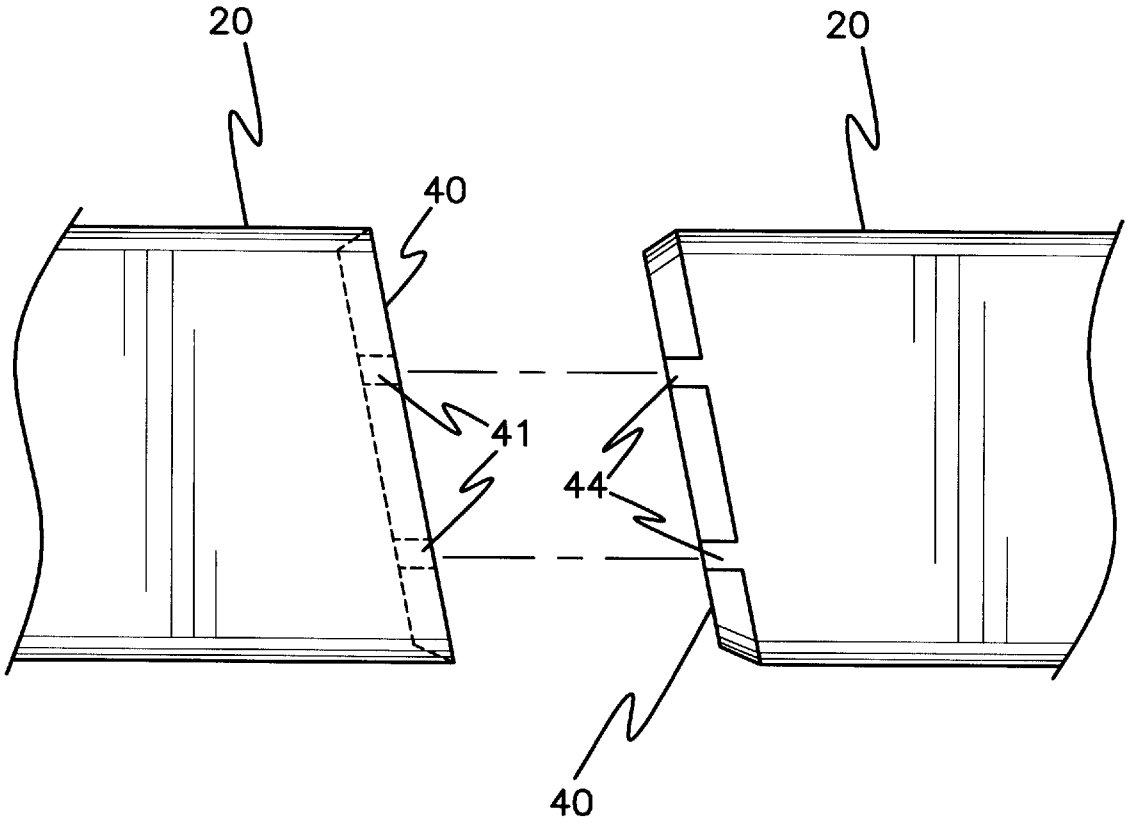
FIG. 3 is a side view illustrating the manner in which adjacent conduit sections are joined together.

Referring now to FIG. 3, a side view of the connection means for interconnecting successive lengths of conduit 20 is shown. The left side of conduit 20 is provided with a diagonal beveled end 40 which includes a pair of female indentations 41. Right hand conduit 20 includes a mating beveled diagonal end 40 and a pair of male projections 44 which are received in female indentations 41. Thus it can readily be seen that by bringing left and right hand conduits 20 into longitudinal engagement, the opposing bevels will form a smooth joint. Additionally, the bevels assist in aligning two sections as they are joined end to end. Male projections 44 will enter female indentations 41, with the various components snapping into place to secure and seal the ends together. The opposite ends of all three sides of conduit 20 are similarly equipped for joining to an adjacent conduit 20. Other suitable variations of locking means can be provided to ensure sealing and locking of conduits 20 together.

If desired, outlets 32A, 32B could be protected against clogging by fixing a mesh (not shown) over the opening to conduit 20.

Of course, many aspects of the above described preferred embodiment are subject to numerous variations within the scope of the appended claims. For example the precise nature of the locking means could be any sort of any sort of snap fit arrangement commonly used in pipe joints and connectors. Also, the diverter pipes, illustratively shown as exiting at right angles to the main pipe axis, could obviously be angled toward the main pipe axis in a direction to divert flow without causing such an abrupt directional change in the fluid flow.

It is to be understood that the present invention is not limited to the embodiments described above, but encompasses any and all embodiments within the scope of the following claims.

I claim:

1. A generally triangular multiple compartment drainage conduit and diverter comprising;

a base portion connected to a pair of upwardly and inwardly inclined walls having an apex located above the horizontal centerline of said base portion;

said pair of inclined walls having diverter outlet means for diverting excess flow therein;

an internal horizontal partition interconnecting the midpoints of said inclined walls forming a primary flow compartment therebelow;

an internal vertical partition interconnecting said apex and said horizontal partition at its midpoint;

said internal horizontal and vertical partitions forming a pair of secondary flow compartments thereabove;

a plurality of apertures in said horizontal and vertical partitions for diverting excess flow in said primary flow compartment;

a plurality of scoop openings in said vertical partition for directing excess flow from said secondary compartment to said diverter outlet means in said inclined walls, and self alignment interconnecting means for joining together a plurality of said multiple compartment drainage conduits forming a drainage system.

2. The multiple compartment drainage conduit with diverter according to claim 1, wherein all external wall intersections have a smooth curvature to increase structural integrity and reduce stress points.

3. The multiple compartment drainage conduit and diverter according to claim 1, wherein all internal wall intersections are a smooth curvature to reduce turbulence and eddies therein.

4. The multiple compartment drainage conduit and diverter according to claim 1, wherein the said conduit is formed of molded recycled plastic products.

5. The multiple compartment drainage conduit according to claim 1, wherein the said conduit is formed of molded fiberglass reinforced concrete products.

6. A multiple compartment drainage conduit according to claim 1, wherein said diverter outlet means comprises knock-out plugs located in said inclined walls and diverter pipes are attached to openings created when said knock-out plugs are removed, diverter pipes connected to said openings for carrying excess flow to predesignated areas.

7. A multiple compartment drainage conduit according to claim 1, wherein said interconnecting means comprises cooperating indentations and projections on respective ends of mating conduit sections to seal and lock said sections together.

8. A multiple compartment drainage conduit according to claim 7, wherein said self alignment means comprises a plurality of beveled or diagonal end faces on each of said conduits which engage each other and assist in there alignment.

9. A drainage system comprising;

a plurality of multiple compartment drainage conduits and cooperating diverters for carrying off excess flow in said drainage conduits;

each of said plurality of multiple compartment drainage conduits having upwardly and inwardly inclined walls having an apex located above the horizontal centerline of said base portion;

said pair of inclined walls having diverter outlet means for diverting excess flow therethrough;

an internal horizontal partition interconnecting the midpoints of said inclined walls forming a primary flow compartment therebelow;

an internal vertical partition interconnecting said apex and said horizontal partition at its midpoint;

said internal horizontal and vertical partitions forming a pair of secondary flow compartments thereabove;

a plurality of scoop openings in said vertical partition for directing excess flow from one of said secondary flow compartments to said diverter outlet means in one of said inclined walls;

self alignment interconnecting means for joining together a plurality of said multiple compartment drainage conduits; and a plurality of diverter pipes connected to said diverter outlet means for diverting excess flow from said multiple compartment drainage conduit to predesignated sites forming a drainage system.

* * * * *